US012595665B2

(12) United States Patent
He

(10) Patent No.: US 12,595,665 B2
(45) Date of Patent: Apr. 7, 2026

(54) DRY-LAID TILE STRUCTURE AND LAYING METHOD THEREOF

(71) Applicant: CHANGZHOU HAOYOUJIE INTELLIGENT TECHNOLOGY CO., LTD., Jiangsu (CN)

(72) Inventor: Guoxin He, Suzhou (CN)

(73) Assignee: CHANGZHOU HAOYUJIE INTELLIGENT TECHNOLOGY CO., LTD., Jiangsu (CN)

( * ) Notice: Subject to any disclaimer, the term of this patent is extended or adjusted under 35 U.S.C. 154(b) by 179 days.

(21) Appl. No.: 18/433,365

(22) Filed: Feb. 5, 2024

(65) Prior Publication Data

US 2024/0392580 A1 Nov. 28, 2024

(30) Foreign Application Priority Data

May 26, 2023 (CN) ..... 202310602256.9

(51) Int. Cl.
*E04F 15/02* (2006.01)
*E04F 15/10* (2006.01)
*E04F 15/08* (2006.01)

(52) U.S. Cl.
CPC ..... *E04F 15/02005* (2013.01); *E04F 15/105* (2013.01); *E04F 15/02194* (2013.01); *E04F 15/087* (2013.01); *E04F 2201/026* (2013.01); *E04F 2201/0511* (2013.01)

(58) Field of Classification Search
None
See application file for complete search history.

(56) References Cited

U.S. PATENT DOCUMENTS 7,610,731 B1 * 11/2009 Collison ..... E04F 15/02194 428/492
9,631,375 B1 * 4/2017 Barlow ..... E04F 15/225
2005/0166513 A1 * 8/2005 Vanderhoef ..... E04F 15/105 52/578

(Continued)

FOREIGN PATENT DOCUMENTS

CA 2752195 A1 * 12/2011 ..... E04F 15/02038
CA 2866484 A1 * 10/2014

(Continued)

*Primary Examiner* — Phi D A
(74) *Attorney, Agent, or Firm* — JCIPRNET

(57) ABSTRACT

A dry-laid tile structure and a tile dry-laying method are provided. A tile includes a tile body and a plastic frame. The plastic frame includes a frame body, first connection assemblies, and second connection assemblies. The frame body is provided with a limit groove and an insertion groove. First connection assembly protruding blocks are respectively provided on top sides of the first connection assemblies. The second connection assemblies protruding blocks respectively include extension portions. The extension portions are respectively provided with hook grooves. When two adjacent tiles are laid, the hook grooves on the extension portions of a first tile of the two adjacent tiles are respectively engaged with the first connection assembly protruding blocks on a second tile of the two adjacent tiles, and the second connection assembly protruding blocks on the extension portions of the first tile are inserted into the insertion groove on the second tile.

4 Claims, 7 Drawing Sheets

(56) References Cited

U.S. PATENT DOCUMENTS

2006/0185297 A1* 8/2006 Mei ..... E04F 15/105 52/506.05
2008/0072514 A1* 3/2008 Barlow ..... E01C 5/22 52/540
2009/0031658 A1* 2/2009 Moller, Jr. ..... E01C 13/045 52/578
2010/0313510 A1* 12/2010 Tang ..... E04F 15/182 52/578
2011/0023389 A1* 2/2011 Myers ..... E04F 15/105 52/173.1
2011/0120037 A1* 5/2011 Barlow ..... E04F 15/105 52/309.1
2011/0179728 A1* 7/2011 Cerny ..... E01C 5/001 52/741.11
2012/0304566 A1* 12/2012 Thrush ..... E04F 15/105 52/302.1
2013/0167458 A1* 7/2013 Cerny ..... E04F 15/10 52/177
2016/0273233 A1* 9/2016 Pekovsek ..... E04F 11/002
2018/0094442 A1* 4/2018 Barlow ..... E04F 15/187
2018/0119430 A1* 5/2018 Gautreau ..... E04F 15/181
2019/0186155 A1* 6/2019 Huss ..... A47G 27/0293
2022/0302856 A1* 9/2022 Daniels ..... H01R 13/6205
2022/0381041 A1* 12/2022 Perrine ..... E04F 21/22
2023/0167645 A1* 6/2023 Goetz ..... E04F 13/0846 52/582.1
2023/0203822 A1* 6/2023 Pressnell ..... E01C 5/20 52/177
2023/0383542 A1* 11/2023 Quist ..... E04F 13/0894
2024/0052641 A1* 2/2024 Boucké ..... E04F 15/02038
2024/0125132 A1* 4/2024 Prizzi ..... A47F 5/0846
2024/0247497 A1* 7/2024 Sieder ..... E04F 13/0894
2024/0295127 A1* 9/2024 Brulinski ..... E04F 15/185
2025/0012086 A1* 1/2025 Claerhout ..... E04F 15/102
2025/0052069 A1* 2/2025 Takagi ..... E04F 13/0894
2025/0223808 A1* 7/2025 Lingg ..... E04F 15/02038
2025/0223810 A1* 7/2025 Boo ..... E04F 15/102
2025/0237063 A1* 7/2025 Hickman ..... E04F 13/0894

FOREIGN PATENT DOCUMENTS

CN 110792243 2/2020
EP 2199490 A2 * 6/2010 ..... E04F 15/10
GB 2524002 A * 9/2015 ..... E04F 15/105
KR 100971615 B1 * 7/2010 ..... E04F 13/14
WO WO-2005003574 A1 * 1/2005 ..... E01C 5/22
WO WO-2014068087 A1 * 5/2014 ..... E04F 15/105
WO WO-2020159355 A1 * 8/2020 ..... E04F 13/10

* cited by examiner

DRY-LAID TILE STRUCTURE AND LAYING METHOD THEREOF

CROSS-REFERENCE TO RELATED APPLICATION

This application claims the priority benefit of Chinese application serial no. 202310602256.9, filed on May 26, 2023. The entirety of the above-mentioned patent application is hereby incorporated by reference herein and made a part of this specification.

TECHNICAL FIELD

The present disclosure relates to the technical field of building decoration, and in particular, to a dry-laid tile structure and a laying method thereof.

BACKGROUND

At present, prefabricated decoration technologies are increasingly used in the field of interior decoration to replace conventional cement mortar construction materials and processes, which lower the difficulty and improve the efficiency of construction, reduce the loads on exposed surfaces, and answer the call for energy conservation and emission reduction in the industry. The patent CN201911147623 discloses a floor tile and a laying method thereof, where connection structures of tiles are formed by injection molding of plastic buckles on the tiles. However, the second groove mentioned in the patent is rectangular, which is difficult to process and may easily cause stress concentration due to the sharp groove opening and result in damage during actual processing. Besides, no mold clamping plane is provided on the back of the tile, and since deep grooved textures are formed on the back of the tile in the industry, the plastic may easily overflow during injection molding, causing problems in injection molding quality and cost. In addition, the connection structures in the patent are abutting structures, no horizontal constraints exist between adjacent tiles after they are connected, and the tiles are fixed to the floor by nails only. However, since the main parts of the connection structures are plastic, after the tiles are fixed by nails, people walking on the tiles may easily cause the nail holes to expand and the tiles will become loose.

Therefore, it is in urgent need of a new dry-laid tile structure and a laying method thereof to solve the above problems.

SUMMARY

To solve the above technical problems, the present disclosure provides a dry-laid tile structure and a laying method thereof. Profiled groove openings are provided to ensure the injection molding quality of the tile, and the special structural design of a plastic frame realizes complete constraints in the vertical and horizontal directions after the tiles are laid, which ensures interconnection of the adjacent tile structures after being laid.

The present disclosure is implemented through the following technical solutions.

A dry-laid tile structure is provided. A tile includes a tile body and a plastic frame, where the plastic frame is fixed on four side edges of the tile body and the plastic frame includes a frame body, first connection assemblies, and second connection assemblies; the frame body is provided with a limit groove and an insertion groove in an extension direction, the first connection assemblies are fixed in the limit groove, the second connection assemblies are fixed on the frame body, and the first connection assemblies and the second connection assemblies on two opposite ones of the four side edges of the tile body are arranged in pairs to be spaced apart and staggered; first connection assembly protruding blocks are respectively provided on top sides of the first connection assemblies, the second connection assemblies respectively include extension portions and second connection assembly protruding blocks, the extension portions are fixed on the frame body, hook grooves are respectively provided on inner bottom sides of the extension portions, and the second connection assembly protruding blocks are respectively located at free ends of the extension portions; when two adjacent tiles are laid, the hook grooves on the extension portions of a first tile of the two adjacent tiles are respectively engaged with the first connection assembly protruding blocks on a second tile of the two adjacent tiles, and the second connection assembly protruding blocks on the extension portions of the first tile are inserted into the insertion groove on the second tile.

Preferably, each of the first connection assembly protruding blocks has a trapezoidal cross-section and a shape of each of the hook grooves matches with a shape of each of the first connection assembly protruding blocks.

Preferably, each of the second connection assembly protruding blocks has a trapezoidal cross-section and a shape of the insertion groove matches with a shape of each of the second connection assembly protruding blocks.

Further, an insertion piece is provided at each of the free ends of the extension portions, the insertion piece has a wedge-shaped structure with a horizontal upper surface and an inclined lower surface, and the insertion groove provided on the frame body has an arc-shaped structure.

Further, the four side edges on a back side of the tile body are each provided with a profiled groove opening, the profiled groove opening includes a plastic fastening groove, a plastic main structure groove, and an injection mold clamping step-shaped groove sequentially arranged from top to bottom, the plastic fastening groove has an end of an arc-shaped structure and is located in a middle of a respective one of the four side edges of the tile body, the injection mold clamping step-shaped groove extends to a bottom of the respective one of the four side edges of the tile body, and the plastic frame is integrated with the tile body by injection molding at the profiled groove opening.

A tile dry-laying method is used for the dry-laid tile structure as described above and includes the following steps:

S1: putting the first tile in place;

S2: inserting and fastening the second tile, including allowing the hook grooves on the extension portions on one of the four side edges of the tile body of the first tile to be respectively engaged with the first connection assembly protruding blocks on one of the four side edges of the tile body of the second tile, the second connection assembly protruding blocks on the extension portions on the one of the four side edges of the tile body of the first tile to be inserted into the insertion groove on the second tile, the hook grooves on the extension portions on the one of the four side edges of the tile body of the second tile to be respectively engaged with the first connection assembly protruding blocks on the one of the four side edges of the tile body of the first tile, and the second connection assembly protruding blocks on the extension portions on the one of the four side edges of the tile body of the second tile to be inserted into the insertion groove on the first tile;

S3: inserting and fastening a third tile, including allowing the hook grooves on the extension portions on another one of the four side edges of the tile body of the first tile to be respectively engaged with the first connection assembly protruding blocks on one of the four side edges of the tile body of the third tile, the second connection assembly protruding blocks on the extension portions on the another one of the four side edges of the tile body of the first tile to be inserted into the insertion groove on the third tile, the hook grooves on the extension portions on the one of the four side edges of the tile body of the third tile to be respectively engaged with the first connection assembly protruding blocks on the another one of the four side edges of the tile body of the first tile, and the second connection assembly protruding blocks on the extension portions on the one of the four side edges of the tile body of the third tile to be inserted into the insertion groove on the first tile;

S4: inserting and fastening a fourth tile, including allowing the fourth tile to be kept a distance away from one of the second tile and the third tile which are laid and to be inserted and fastened with the other of the second tile and the third tile according to the step S2 or S3, and then pushing the fourth tile in a vertical direction to allow the fourth tile to be inserted and fastened with the one of the second tile and the third tile which is kept the distance away from the fourth tile; and S5: laying tiles on a whole floor according to the steps S1 to S4.

The present disclosure has the following advantages.

According to the dry-laid tile structure and the laying method thereof provided by the present disclosure, the profiled groove openings are provided to ensure the injection molding quality of the tile, and the special structural design of the plastic frame realizes complete constraints in the vertical and horizontal directions after the tile structures are laid, which ensures interconnection of the adjacent tile structures after being laid, achieves high laying efficiency, and meets the environmental protection requirement of carbon emission reduction in the industry.

Figure 1:
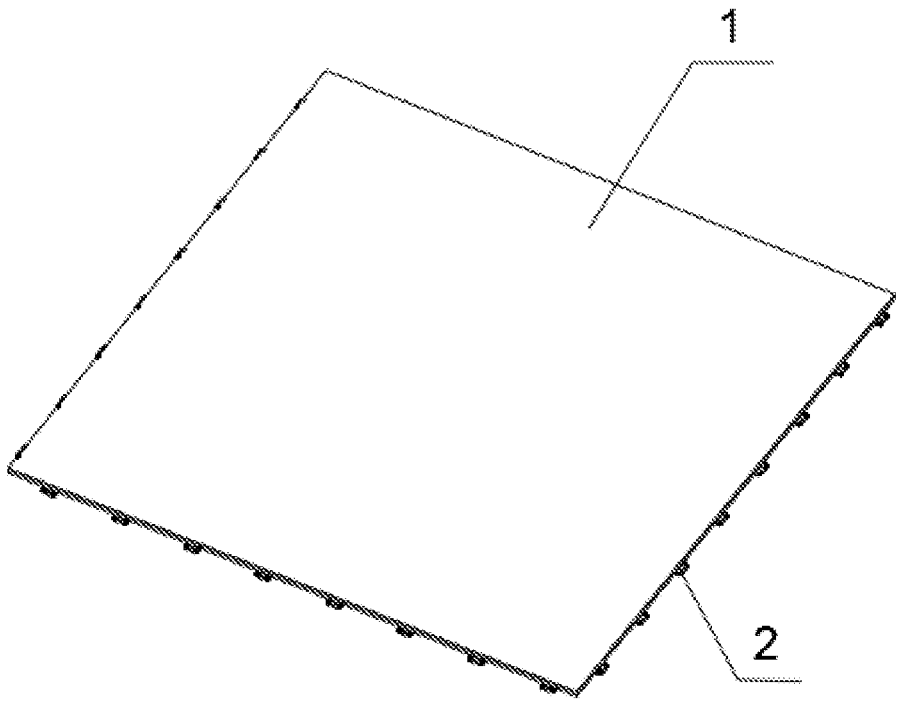
FIG. 1 is a schematic top view of the structure of the present disclosure.

In the drawings: 1. tile body, 11. plastic fastening groove, 12. plastic main structure groove, 13. injection mold clamping step-shaped groove, 2. plastic frame, 21. frame body, 211. limit groove, 212. insertion groove, 22. first connection assembly, 221. first connection assembly protruding block, 23. second connection assembly, 231. extension portion, 232. hook groove, 233. second connection assembly protruding block, 234. insertion piece.

DETAILED DESCRIPTION OF THE EMBODIMENTS

Figure 2:
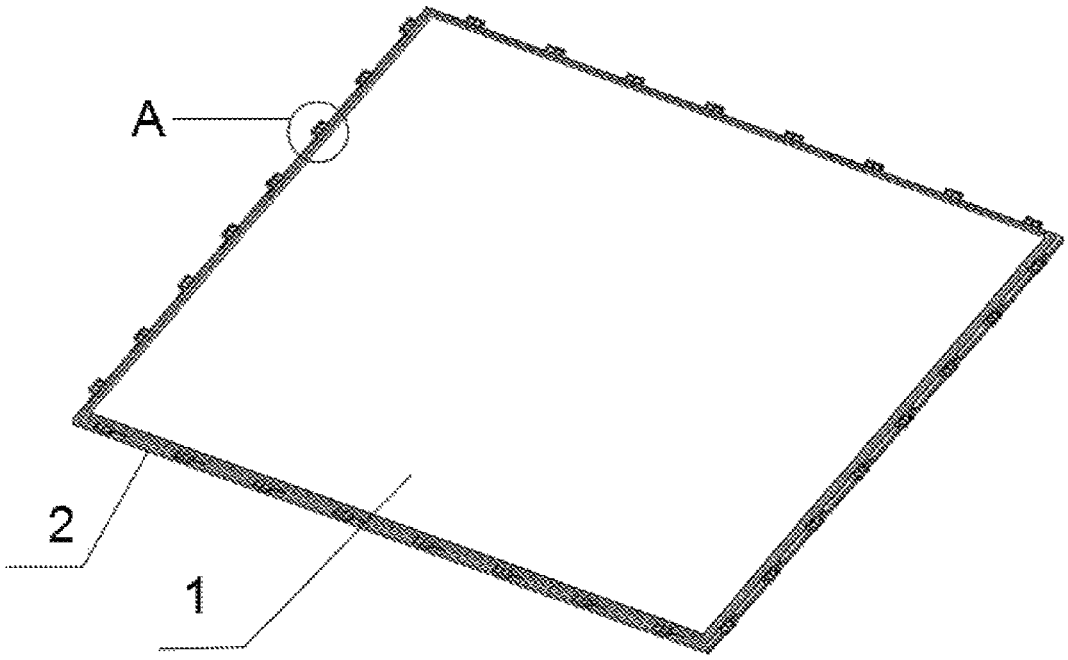
FIG. 2 is a schematic bottom view of the structure of the present disclosure.
Figure 3:
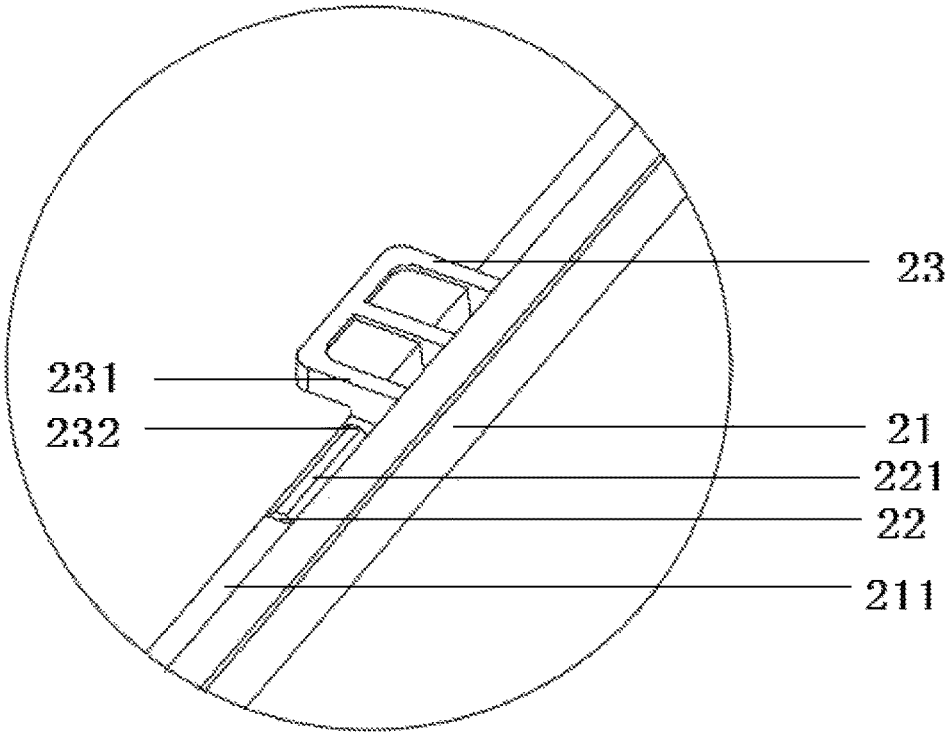
FIG. 3 is an enlarged schematic structural diagram of the part A.

A dry-laid tile structure is provided. A tile includes a tile body 1 and a plastic frame 2. The specific structure of the tile is shown in FIG. 1 to FIG. 3. The plastic frame is fixed on four side edges of the tile body and the plastic frame includes a frame body 21, first connection assemblies 22, and second connection assemblies 23. The frame body is provided with a limit groove 211 and an insertion groove 212 in an extension direction. The first connection assemblies are fixed in the limit groove, the second connection assemblies are fixed on the frame body, and the first connection assemblies and the second connection assemblies on two opposite ones of the four side edges of the tile body are arranged in pairs to be spaced apart and staggered. First connection assembly protruding blocks 221 are respectively provided on top sides of the first connection assemblies. The second connection assemblies respectively include extension portions 231 and second connection assembly protruding blocks 233, the extension portions are fixed on the frame body, hook grooves 232 are respectively provided on inner bottom sides of the extension portions, and the second connection assembly protruding blocks are respectively located at free ends of the extension portions. When two adjacent tiles are laid, the hook grooves on the extension portions of a first tile of the two adjacent tiles are respectively engaged with the first connection assembly protruding blocks on a second tile of the two adjacent tiles, and the second connection assembly protruding blocks on the extension portions of the first tile are inserted into the insertion groove on the second tile.

By using the dry-laid tile structure provided by the present disclosure, the adjacent tiles laid on the floor are completely constrained in the vertical and horizontal directions, so that the adjacent tiles are interconnected, the loosening of the tiles will not be caused by people walking on the tiles, and the joints with a fixed width are naturally formed between the tiles and will get a uniform and fine appearance after later grouting.

Figure 4:
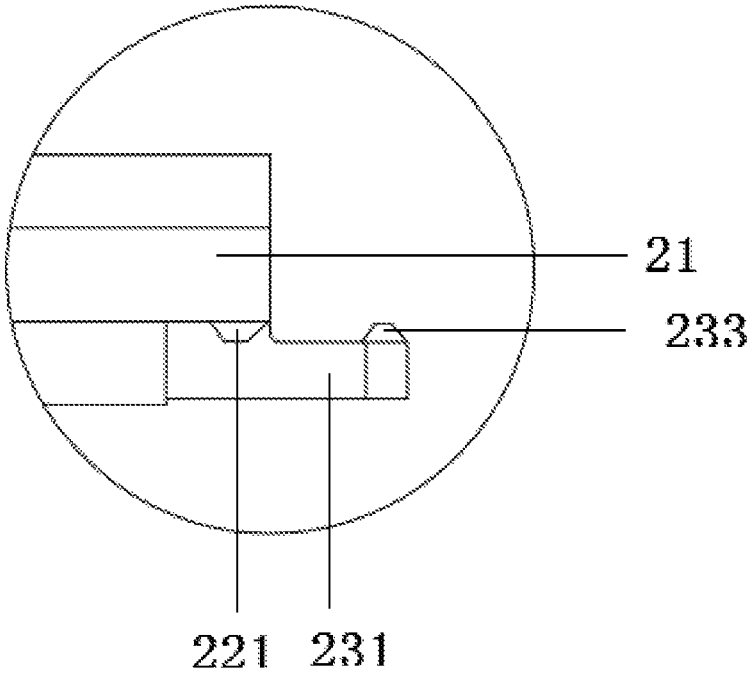
FIG. 4 is a schematic side view of the structure in Embodiment 1 of the present disclosure.
Figure 5:
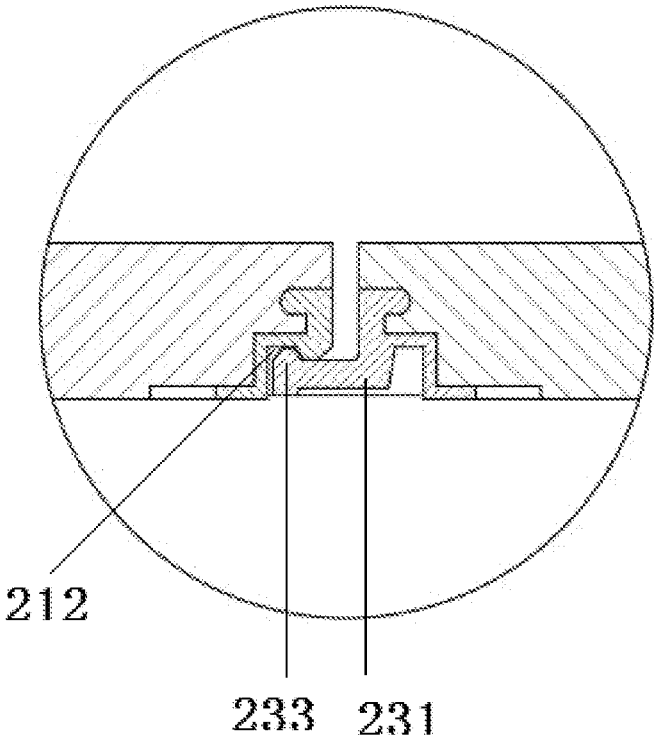
FIG. 5 is a schematic assembly view of the structure in Embodiment 1 of the present disclosure.

Embodiment 1 is described below with reference to FIG. 4 and FIG. 5. Each of the first connection assembly protruding blocks has a trapezoidal cross-section and a shape of each of the hook grooves matches with a shape of each of the first connection assembly protruding blocks, so that the adjacent tiles are completely constrained in the vertical and horizontal directions and they can be conveniently inserted and fastened together. Each of the second connection assembly protruding blocks has a trapezoidal cross-section and a shape of the insertion groove matches with a shape of each of the second connection assembly protruding blocks, so that the adjacent tiles are further completely constrained in the vertical and horizontal directions and they can be conveniently inserted and fastened together.

Figure 6:
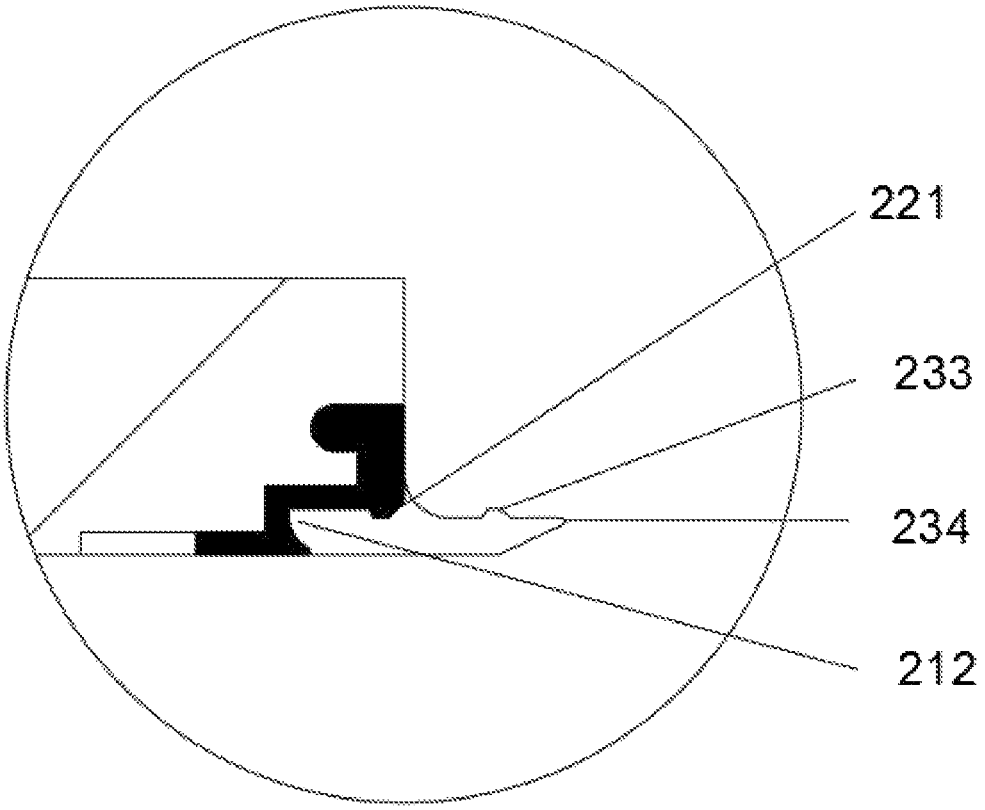
FIG. 6 is a schematic side view of the structure in Embodiment 2 of the present disclosure.
Figure 7:
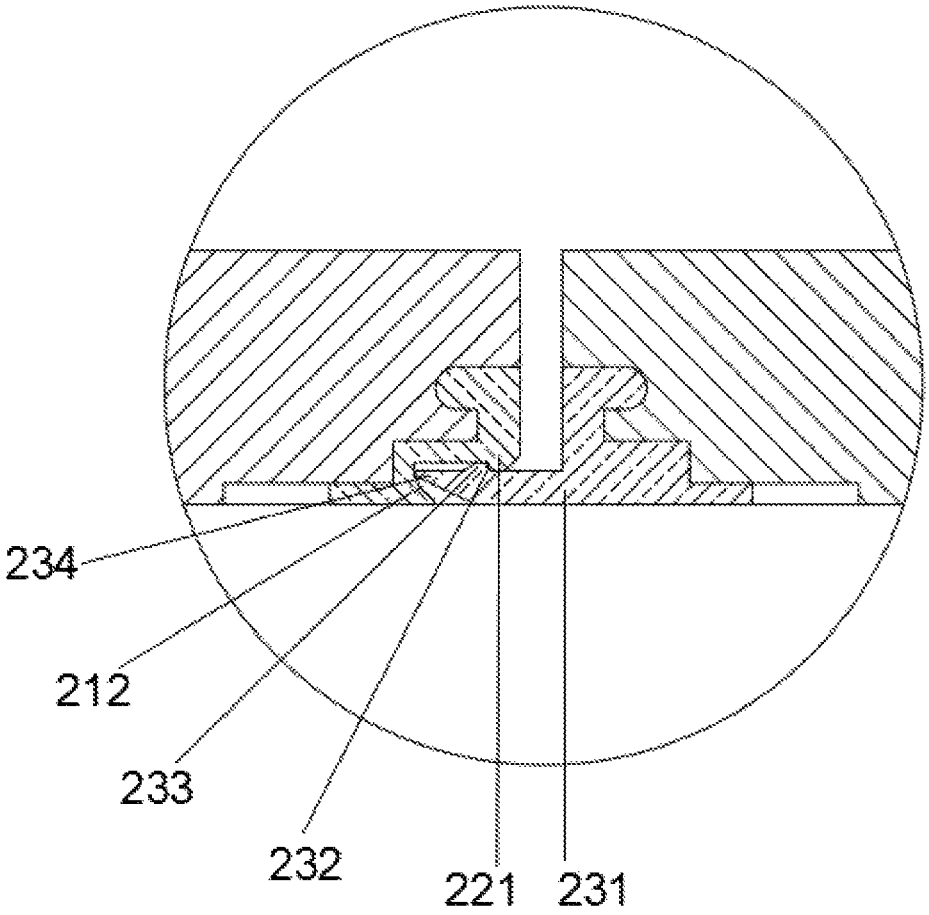
FIG. 7 is a schematic assembly view of the structure in Embodiment 2 of the present disclosure.
Figure 8:
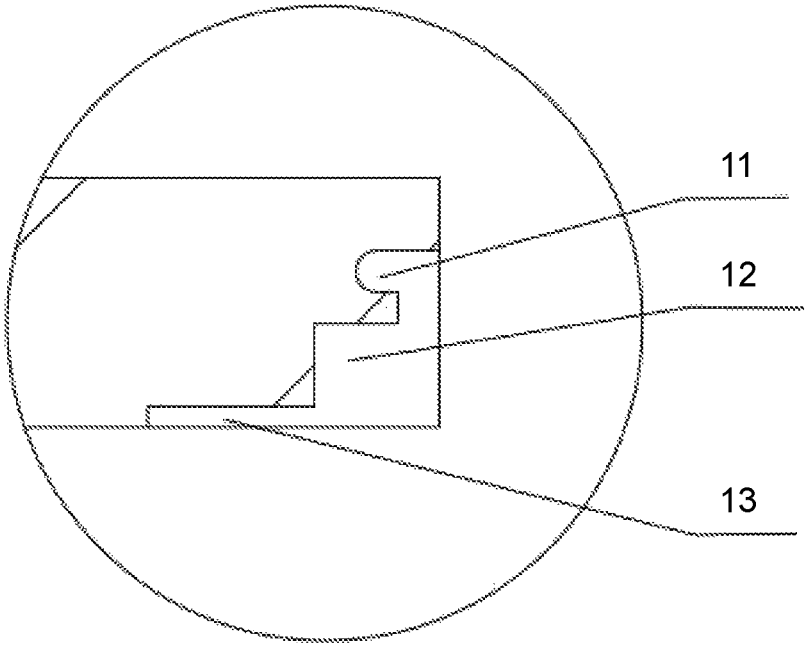
FIG. 8 is a schematic structural diagram of a profiled groove opening in the present disclosure.

Embodiment 2 is described below with reference to FIG. 6 and FIG. 7. An insertion piece 234 is provided at each of the free ends of the extension portions, the insertion piece has a wedge-shaped structure with a horizontal upper surface and an inclined lower surface, and the insertion groove provided on the frame body has an arc-shaped structure. As the second connection assembly deforms downward during the tile laying process, the constraints between two tiles are insufficient if they rely on the engagement of the second connection assembly protruding block with the insertion groove on the other tile. Therefore, by providing the wedge-shaped insertion piece at the free end of the extension portion and providing the insertion groove on the frame body, when the insertion piece contacts the insertion groove on the other tile, the second connection assembly gradually rises upward and returns to its original state due to the arc-shaped surface of the insertion groove, so that sufficient horizontal constraints are formed between the second connection assembly protruding block and the insertion groove on the other tile, which ensures that the adjacent tiles are firmly constrained after being laid in place. Further, the four side edges on a back side of the tile body are each provided with a profiled groove opening. As shown in FIG. 8, the profiled groove opening includes a plastic fastening groove 11, a plastic main structure groove 12, and an injection mold clamping step-shaped groove 13 sequentially arranged from top to bottom. The plastic fastening groove has an end of an arc-shaped structure and is located in a middle of a respective one of the four side edges of the tile body, the injection mold clamping step-shaped groove extends to a bottom of the respective one of the four side edges of the tile body, and the plastic frame is integrated with the tile body by injection molding at the profiled groove opening.

The plastic fastening groove mainly applies a tightening force on the tile after the plastic frame is injection molded. Since the plastic fastening groove has an end of an arc-shaped structure, the contact area between the tile body and the plastic frame after injection molding is increased to prevent stress concentration, and the contraction of the plastic when being cooled down after injection molding makes the plastic frame more firmly fastened around the tile body.

The plastic main structure groove is injection molded to increase the contact area between the plastic frame and the tile body and serve as the main structure of the plastic frame.

The injection mold clamping step-shaped groove is formed by opening a groove on the tile body by a fixed thickness. The injection mold clamping step-shaped groove extends to the bottom of the side edge of the tile body, which reduces the thickness tolerance of the tile body to ensure that the tile will not be damaged in mold clamping due to thickness deviation in the injection mold. Moreover, the injection mold clamping step-shaped groove serves as a support plane of the lower mold during injection mold clamping, which prevents plastic overflow from affecting the injection molding quality in the injection molding process.

Figure 9:
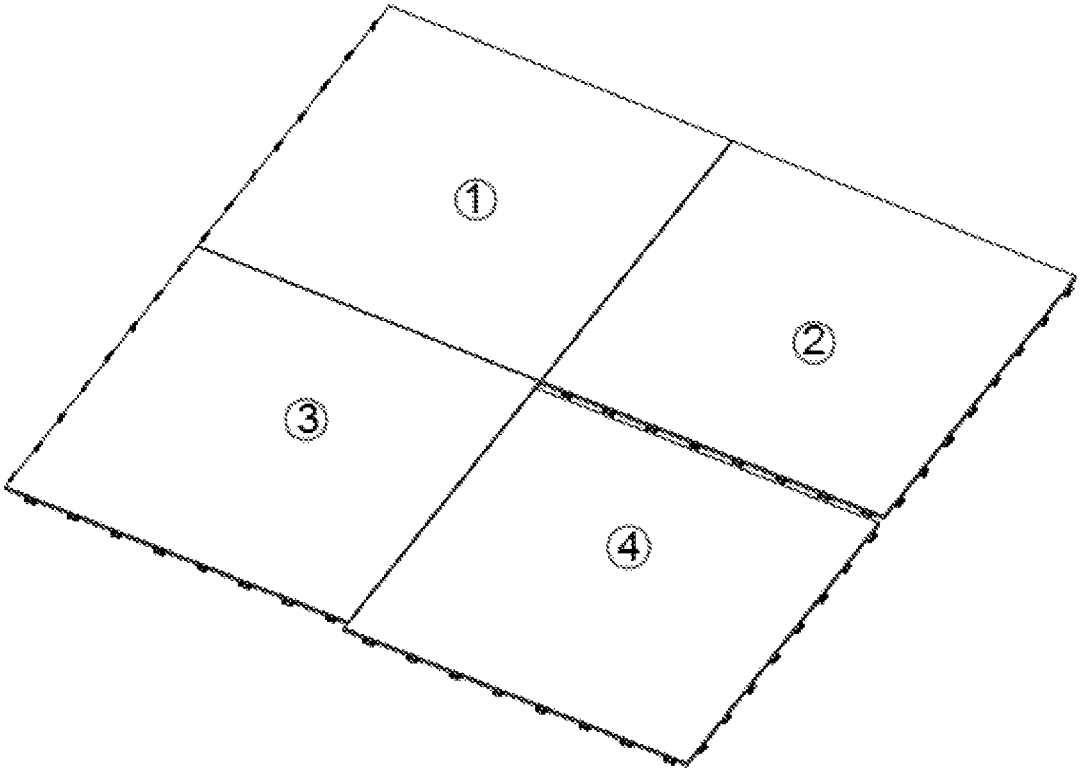
FIG. 9 is a first schematic diagram of a laying sequence according to a laying method of the present disclosure.
Figure 10:
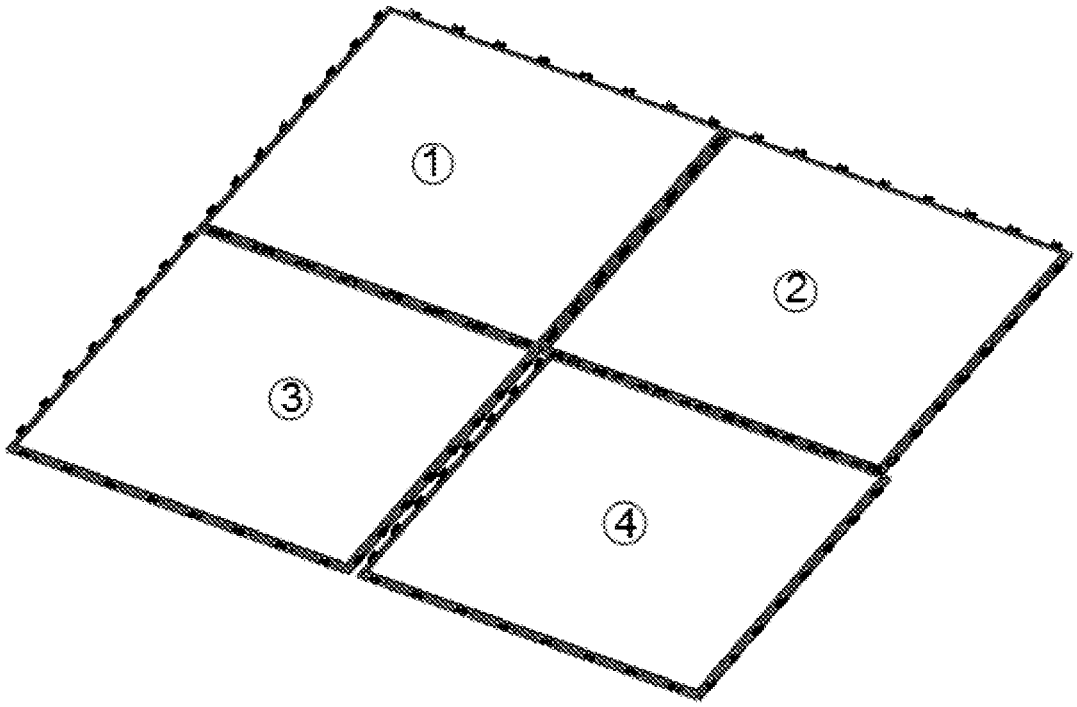
FIG. 10 is a second schematic diagram of the laying sequence according to the laying method of the present disclosure.

A tile dry-laying method is used for the dry-laid tile structure as described above, and the laying sequence is shown in FIG. 9 and FIG. 10. The method includes the following steps.

S1: The first tile is put in place.

S2: The second tile is inserted and fastened. The hook grooves on the extension portions on one of the four side edges of the tile body of the first tile are respectively engaged with the first connection assembly protruding blocks on one of the four side edges of the tile body of the second tile, the second connection assembly protruding blocks on the extension portions on the one of the four side edges of the tile body of the first tile are inserted into the insertion groove on the second tile, the hook grooves on the extension portions on the one of the four side edges of the tile body of the second tile are respectively engaged with the first connection assembly protruding blocks on the one of the four side edges of the tile body of the first tile, and the second connection assembly protruding blocks on the extension portions on the one of the four side edges of the tile body of the second tile are inserted into the insertion groove on the first tile.

S3: A third tile is inserted and fastened. The hook grooves on the extension portions on another one of the four side edges of the tile body of the first tile are respectively engaged with the first connection assembly protruding blocks on one of the four side edges of the tile body of the third tile, the second connection assembly protruding blocks on the extension portions on the another one of the four side edges of the tile body of the first tile are inserted into the insertion groove on the third tile, the hook grooves on the extension portions on the one of the four side edges of the tile body of the third tile are respectively engaged with the first connection assembly protruding blocks on the another one of the four side edges of the tile body of the first tile, and the second connection assembly protruding blocks on the extension portions on the one of the four side edges of the tile body of the third tile are inserted into the insertion groove on the first tile.

S4: A fourth tile is inserted and fastened. The fourth tile is kept a distance away from one of the second tile and the third tile which are laid and is inserted and fastened with the other of the second tile and the third tile according to the step S2 or S3. The fourth tile is then pushed in a vertical direction to be inserted and fastened with the one of the second tile and the third tile which is kept the distance away from the fourth tile. The purpose of keeping the distance is to prevent interference between the connection assemblies of the fourth tile and the tile not to be involved. The distance is set to ensure no interference between the connection assemblies of the two tiles.

S5: Tiles are laid on the whole floor according to the steps S1 to S4.

The tile structure provided by the present disclosure can be used to realize dry-laying of the tiles and the conventional cement mortar materials are not needed. The difficulty of the tile laying process is reduced, the operability of tile laying is improved, and the labor productivity is raised. Besides, the efficiency of decoration construction is greatly improved, the construction period is shortened, and the delivery cost is reduced. Since the plastics are recyclable materials and the tiles can also be recycled and further processed into porcelain products, all the materials of the tile structure are recyclable and reusable. As for later maintenance and replacement, the process difficulty is greatly reduced and no noise is generated during construction. Besides, no waste is produced during construction and the materials can be reused after recycling, which meet the environmental protection requirement of carbon emission reduction in the industry. To sum up, according to the dry-laid tile structure and the laying method thereof provided by the present disclosure, the profiled groove openings are provided to ensure the injection molding quality of the tile, and the special structural design of the plastic frame realizes complete constraints in the vertical and horizontal directions after the tile structures are laid, which ensures interconnection of the adjacent tile structures after being laid, achieves high laying efficiency, and meets the environmental protection requirement of carbon emission reduction in the industry.

The above descriptions are merely preferred embodiments of the present disclosure and are not intended to limit the present disclosure. Persons skilled in the art can make various modifications and changes to the present disclosure. Any modification, equivalent replacement, improvement, etc. made within the spirit and principle of the present disclosure shall fall within the protection scope of the present disclosure.

What is claimed is:

1. A dry-laid tile structure, wherein a tile comprises a tile body and a plastic frame, wherein the plastic frame is fixed on four side edges of the tile body and the plastic frame comprises a frame body, first connection assemblies, and second connection assemblies; the frame body is provided with a limit groove and an insertion groove in an extension direction, the first connection assemblies are fixed in the limit groove, the second connection assemblies are fixed on the frame body, and the first connection assemblies and the second connection assemblies on two opposite ones of the four side edges of the tile body are arranged in pairs to be spaced apart and staggered; first connection assembly protruding blocks are respectively provided on top sides of the first connection assemblies, the second connection assemblies respectively comprise extension portions and second connection assembly protruding blocks, the extension portions are fixed on the frame body, hook grooves are respectively provided on inner bottom sides of the extension portions, and the second connection assembly protruding blocks are respectively located at free ends of the extension portions; when two adjacent tiles are laid, the hook grooves on the extension portions of a first tile of the two adjacent tiles are respectively engaged with the first connection assembly protruding blocks on a second tile of the two adjacent tiles, and the second connection assembly protruding blocks on the extension portions of the first tile are inserted into the insertion groove on the second tile, wherein an insertion piece is provided at each of the free ends of the extension portions, the insertion piece has a wedge-shaped structure with a horizontal upper surface and an inclined lower surface, and the insertion groove provided on the frame body has an arc-shaped structure, wherein the second connection assembly rises upward and returns to an original state due to the arc-shaped surface of the insertion groove, and horizontal constraints are formed between the second connection assembly protruding block and the insertion groove between adjacent tiles, wherein the four side edges on a back side of the tile body are each provided with a profiled groove opening, the profiled groove opening comprises a plastic fastening groove, a plastic main structure groove, and an injection mold clamping step-shaped groove sequentially arranged from top to bottom, the plastic fastening groove has an end of an arc-shaped structure and is located in a middle of a respective one of the four side edges of the tile body, the injection mold clamping step-shaped groove extends to a bottom of the respective one of the four side edges of the tile body, and the plastic frame is integrated with the tile body by injection molding at the profiled groove opening.

2. The dry-laid tile structure according to claim 1, wherein each of the first connection assembly protruding blocks has a trapezoidal cross-section and a shape of each of the hook grooves matches with a shape of each of the first connection assembly protruding blocks.

3. The dry-laid tile structure according to claim 1, wherein each of the second connection assembly protruding blocks has a trapezoidal cross-section and a shape of the insertion groove matches with a shape of each of the second connection assembly protruding blocks.

4. A tile dry-laying method, used for the dry-laid tile structure according to claim 1, wherein the tile dry-laying method comprises the following steps:

S1: putting the first tile in place;

S2: inserting and fastening the second tile, comprising allowing the hook grooves on the extension portions on one of the four side edges of the tile body of the first tile to be respectively engaged with the first connection assembly protruding blocks on one of the four side edges of the tile body of the second tile, the second connection assembly protruding blocks on the extension portions on the one of the four side edges of the tile body of the first tile to be inserted into the insertion groove on the second tile, the hook grooves on the extension portions on the one of the four side edges of the tile body of the second tile to be respectively engaged with the first connection assembly protruding blocks on the one of the four side edges of the tile body of the first tile, and the second connection assembly protruding blocks on the extension portions on the one of the four side edges of the tile body of the second tile to be inserted into the insertion groove on the first tile;

S3: inserting and fastening a third tile, comprising allowing the hook grooves on the extension portions on another one of the four side edges of the tile body of the first tile to be respectively engaged with the first connection assembly protruding blocks on one of the four side edges of the tile body of the third tile, the second connection assembly protruding blocks on the extension portions on the another one of the four side edges of the tile body of the first tile to be inserted into the insertion groove on the third tile, the hook grooves on the extension portions on the one of the four side edges of the tile body of the third tile to be respectively engaged with the first connection assembly protruding blocks on the another one of the four side edges of the tile body of the first tile, and the second connection assembly protruding blocks on the extension portions on the one of the four side edges of the tile body of the third tile to be inserted into the insertion groove on the first tile, wherein insertion pieces provided at the free end of the extension portions contact the insertion grooves of the other tiles, second connection assemblies gradually rise upward and return to an original state due to the arc-shaped surface of the insertion grooves, and horizontal constraints are formed between the second connection assembly protruding blocks and the insertion grooves between adjacent tiles;

S4: inserting and fastening a fourth tile, comprising allowing the fourth tile to be kept a distance away from one of the second tile and the third tile which are laid and to be inserted and fastened with the other of the second tile and the third tile according to the step S2 or S3, and then pushing the fourth tile in a vertical direction to allow the fourth tile to be inserted and fastened with the one of the second tile and the third tile which is kept the distance away from the fourth tile; and S5: laying tiles on a whole floor according to the steps S1 to S4.

* * * * *